US010930193B2

(12) United States Patent
Zhang et al.

(10) Patent No.: US 10,930,193 B2
(45) Date of Patent: Feb. 23, 2021

(54) METHOD, DEVICE, AND ELECTRONIC APPARATUS FOR SCAN SIGNAL GENERATION

(71) Applicant: WUHAN CHINA STAR OPTOELECTRONICS TECHNOLOGY CO., LTD., Hubei (CN)

(72) Inventors: Xin Zhang, Hubei (CN); Juncheng Xiao, Hubei (CN); Chao Tian, Hubei (CN); Yanqing Guan, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/612,146

(22) PCT Filed: Mar. 20, 2019

(86) PCT No.: PCT/CN2019/078797

§ 371 (c)(1),
(2) Date: Nov. 8, 2019

(87) PCT Pub. No.: WO2020/133740

PCT Pub. Date: Jul. 2, 2020

(65) Prior Publication Data

US 2020/0402436 A1 Dec. 24, 2020

(30) Foreign Application Priority Data

Dec. 29, 2018 (CN) ..... 201811639728.3

(51) Int. Cl.
*G09G 3/20* (2006.01)

(52) U.S. Cl.
CPC ..... *G09G 3/20* (2013.01); *G09G 2310/0202* (2013.01); *G09G 2310/0267* (2013.01)

(58) Field of Classification Search
CPC ..... G09G 3/20; G09G 2310/0202; G09G 2310/0267; G09G 3/3674; G09G 3/3677; G09G 3/3681
See application file for complete search history.

(56) References Cited

U.S. PATENT DOCUMENTS 4,087,808 A * 5/1978 Herndon, Jr. ..... G09G 5/26 315/367
5,103,144 A * 4/1992 Dunham ..... H01J 31/127 313/336

(Continued)

FOREIGN PATENT DOCUMENTS

CN 1181571 A 5/1998
CN 1591536 A 3/2005

(Continued)

*Primary Examiner* — Dmitriy Bolotin

(57) ABSTRACT

A method, a device, and an electronic apparatus for scan signal generation are provided. The method includes acquiring an initial clock signal, processing the initial clock signal to generate a plurality of target clock signals, encoding the plurality of target clock signals according to a predetermined logic relationship to generate a plurality of ordered logic signals, decoding the plurality of ordered logic signals, and generating a plurality of scan signals according to a decoding result.

12 Claims, 5 Drawing Sheets

(56) References Cited

U.S. PATENT DOCUMENTS

| | | | | |
|---|---|---|---|---|
| 5,262,698 | A * | 11/1993 | Dunham | G09G 3/2025 315/169.1 |
| 6,239,781 | B1 | 5/2001 | Fujisawa | |
| 2002/0089476 | A1 | 7/2002 | Kang | |
| 2003/0052873 | A1* | 3/2003 | Ueda | G09G 3/2092 345/211 |
| 2004/0263461 | A1* | 12/2004 | Park | G09G 3/3688 345/98 |
| 2005/0062733 | A1* | 3/2005 | Morita | G09G 3/3688 345/204 |
| 2009/0046050 | A1 | 2/2009 | Morita | |
| 2012/0127804 | A1* | 5/2012 | Ong | G11C 7/1006 365/189.2 |
| 2013/0253860 | A1* | 9/2013 | Kim | G02F 1/1309 702/58 |
| 2013/0321363 | A1* | 12/2013 | Su | G09G 3/20 345/204 |
| 2016/0260404 | A1 | 9/2016 | Liu | |
| 2019/0005904 | A1* | 1/2019 | Mitsuzawa | G09G 3/3655 |

FOREIGN PATENT DOCUMENTS

| | | | |
|---|---|---|---|
| CN | 1595478 | A | 3/2005 |
| CN | 101937655 | A | 1/2011 |
| CN | 103700354 | A | 4/2014 |

* cited by examiner

| ordered logic signals | | | scan signals | | | | | | | |
|---|---|---|---|---|---|---|---|---|---|---|
| A | B | C | Gate1 | Gate2 | Gate3 | Gate4 | Gate5 | Gate6 | Gate7 | Gate8 |
| 0 | 0 | 0 | 1 | 0 | 0 | 0 | 0 | 0 | 0 | 0 |
| 0 | 0 | 1 | 0 | 1 | 0 | 0 | 0 | 0 | 0 | 0 |
| 0 | 1 | 0 | 0 | 0 | 1 | 0 | 0 | 0 | 0 | 0 |
| 0 | 1 | 1 | 0 | 0 | 0 | 1 | 0 | 0 | 0 | 0 |
| 1 | 0 | 0 | 0 | 0 | 0 | 0 | 1 | 0 | 0 | 0 |
| 1 | 0 | 1 | 0 | 0 | 0 | 0 | 0 | 1 | 0 | 0 |
| 1 | 1 | 0 | 0 | 0 | 0 | 0 | 0 | 0 | 1 | 0 |
| 1 | 1 | 1 | 0 | 0 | 0 | 0 | 0 | 0 | 0 | 1 |

METHOD, DEVICE, AND ELECTRONIC APPARATUS FOR SCAN SIGNAL GENERATION

FIELD OF INVENTION

The present application generally relates to the display technology and, more particularly, to a method, a device, and an electronic apparatus for scan signal generation.

BACKGROUND OF INVENTION

The gate-driver-on-array (GoA) technology integrates the gate driver circuit on an array substrate of a display panel so as to leave out the gate driver integrated circuit and reduce the product cost in view of the material cost and the process cost.

The conventional GOA circuit is mainly designed using shift registers. In other words, the start signal is shift-transferred using the start signal and the clock signal provided by the driver chip, and the scan signal required for driving a display panel is acquired using a certain number of shift registers.

SUMMARY OF INVENTION

One object of the present application is to provide a method, a device, and an electronic apparatus for scan signal generation, capable of solving the technical problem that the conventional GOA circuit has high functional requirements on the driver chip, thereby causing high cost.

One embodiment of the present application provides a scan signal generation method applicable to a driver chip electrically connected to a plurality of scan lines, wherein the scan signal generation method includes:

acquiring an initial clock signal switching back and forth between a high level and a low level;

processing the initial clock signal to generate a plurality of target clock signals;

encoding the plurality of target clock signals according to a predetermined logic relationship to generate a plurality of ordered logic signals; and decoding the plurality of ordered logic signals, and generating a plurality of scan signals according to a decoding result, wherein the plurality of scan signals is in one-to-one correspondence with the plurality of scan lines.

In the scan signal generation method according to the present application, the step of processing the initial clock signal to generate the plurality of target clock signals includes:

acquiring row and column information of pixel units connected to the plurality of scan lines; and frequency-dividing the initial clock signal according to the row and column information to generate the plurality of target clock signals, wherein the frequency of the $i^{th}$ target clock signal is $1/2^i$ of the frequency of the initial clock signal, i being a positive integer larger than zero.

In the scan signal generation method according to the present application, the initial clock signal is frequency-divided by a frequency divider.

In the scan signal generation method according to the present application, the step of encoding the plurality of target clock signals according to the predetermined logic relationship to generate the plurality of ordered logic signals includes:

dividing each of the plurality of target clock signals into a plurality of time periods, and acquiring a logic value corresponding to each of the plurality of target clock signals in each of the plurality of time periods; and combining the logic value corresponding to each of the plurality of target clock signals to acquire an ordered logic signal corresponding to each of the plurality of time periods.

In the scan signal generation method according to the present application, the step of decoding the plurality of ordered logic signals and generating the plurality of scan signals according to the decoding result includes:

searching for a scan logic signal corresponding to the plurality of ordered logic signals in a decoding truth table; and generating a corresponding scan signal according to the scan logic signal.

One embodiment of the present application further provides a scan signal generation method applicable to a driver chip electrically connected to a plurality of scan lines, wherein the scan signal generation method includes:

acquiring an initial clock signal;

processing the initial clock signal to generate a plurality of target clock signals;

encoding the plurality of target clock signals according to a predetermined logic relationship to generate a plurality of ordered logic signals; and decoding the plurality of ordered logic signals, and generating a plurality of scan signals according to a decoding result, wherein the plurality of scan signals is in one-to-one correspondence with the plurality of scan lines.

In the scan signal generation method according to the present application, the step of processing the initial clock signal to generate the plurality of target clock signals includes:

acquiring row and column information of pixel units connected to the plurality of scan lines; and frequency-dividing the initial clock signal according to the row and column information to generate the plurality of target clock signals, wherein the frequency of the $i^{th}$ target clock signal is $1/2^i$ of the frequency of the initial clock signal, i being a positive integer larger than zero.

In the scan signal generation method according to the present application, the initial clock signal is frequency-divided by a frequency divider.

In the scan signal generation method according to the present application, the step of encoding the plurality of target clock signals according to the predetermined logic relationship to generate the plurality of ordered logic signals includes:

dividing each of the plurality of target clock signals into a plurality of time periods, and acquiring a logic value corresponding to each of the plurality of target clock signals in each of the plurality of time periods; and combining the logic value corresponding to each of the plurality of target clock signals to acquire an ordered logic signal corresponding to each of the plurality of time periods.

In the scan signal generation method according to the present application, the step of decoding the plurality of ordered logic signals and generating the plurality of scan signals according to the decoding result includes:

searching for a scan logic signal corresponding to the plurality of ordered logic signals in a decoding truth table; and generating a corresponding scan signal according to the scan logic signal.

One embodiment of the present application further provides a scan signal generation device including:

an acquisition module configured to acquire an initial clock signal;

a processing module configured to process the initial clock signal to generate a plurality of target clock signals;

an encoding module configured to encode the plurality of target clock signals according to a predetermined logic relationship to generate a plurality of ordered logic signals; and a decoding module configured to decode the plurality of ordered logic signals and generate a plurality of scan signals according to a decoding result, wherein the plurality of scan signals is in one-to-one correspondence with the plurality of scan lines.

In the scan signal generation device according to the present application, the processing module includes:

an acquisition unit configured to acquire row and column information of pixel units connected to the plurality of scan lines; and a frequency divider unit configured to frequency-divide the initial clock signal according to the row and column information to generate the plurality of target clock signals, wherein the frequency of the $i^{th}$ target clock signal is $1/2^i$ of the frequency of the initial clock signal, i being a positive integer larger than zero.

In the scan signal generation device according to the present application, the initial clock signal is frequency-divided by a frequency divider.

In the scan signal generation device according to the present application, the encoding module includes:

a dividing unit configured to divide each of the plurality of target clock signals into a plurality of time periods and acquire a logic value corresponding to each of the plurality of target clock signals in each of the plurality of time periods; and a combining unit configured to combine the logic value corresponding to each of the plurality of target clock signals to acquire an ordered logic signal corresponding to each of the plurality of time periods.

In the scan signal generation device according to the present application, the decoding module includes:

a searching unit configured to search for a scan logic signal corresponding to the plurality of ordered logic signals in a decoding truth table; and a generation unit configured to generate a corresponding scan signal according to the scan logic signal.

One embodiment of the present application further provides an electronic apparatus including a processor and a memory. The memory is provided with computer programs stored therein, and the processor is configured to execute the scan signal generation method by allocating the computer programs stored in the memory.

The method, the device, and the electronic apparatus for scan signal generation according to one embodiment of the present application use an initial clock signal to generate a plurality of scan signals by acquiring the initial clock signal, processing the initial clock signal to generate a plurality of target clock signals, encoding the plurality of target clock signals according to a predetermined logic relationship to generate a plurality of ordered logic signals, decoding the plurality of ordered logic signals, and generating the plurality of scan signals according to a decoding result, to drive a display panel without using too many shift registers.

DESCRIPTION OF DRAWINGS

In order to more clearly illustrate the technical solutions in the embodiments or the prior art, the drawings used in the embodiments or the prior art description will be briefly described below. Obviously, the drawings in the following description are only some implementations of the present application. For example, other drawings may be acquired, without creative efforts, by those of ordinary skill in the art in light of the inventive work.

DETAILED DESCRIPTION OF PREFERRED EMBODIMENTS

Figure 1:
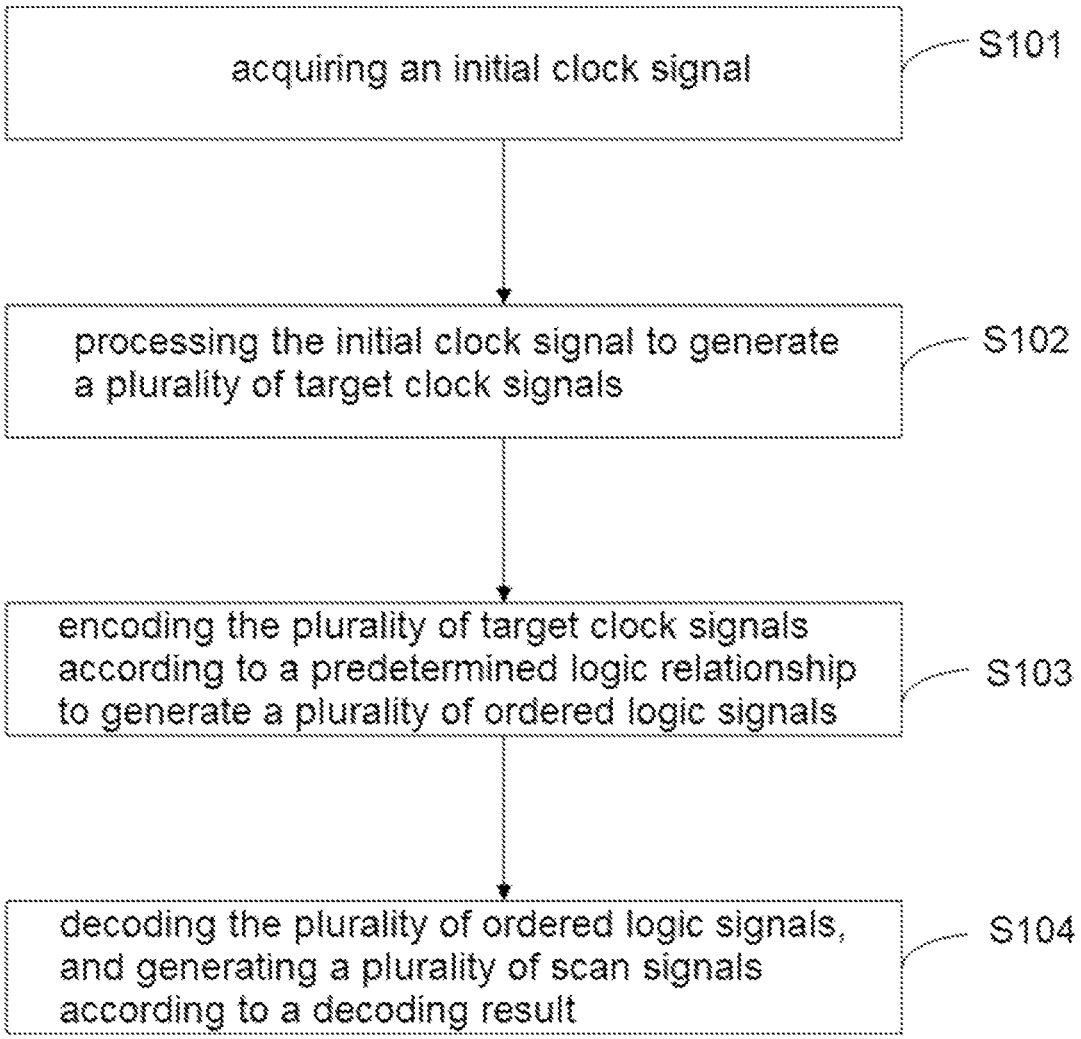
FIG. 1 is a schematic flowchart of a scan signal generation method according to one embodiment of the present application.

The embodiments of the present application are described in detail below, and the examples of the embodiments are illustrated in the accompanying drawings, in which the same or similar reference numerals refer to the same or similar elements or elements having the same or similar functions. The described embodiments are exemplary and are only used to explain the present application, instead of being construed as a limitation on the present application.

In the description of the present application, it is to be understood that the orientations or the positional relationships of the terms "center", "longitudinal", "transverse", "length", "width", "thickness", "upper", "lower", "front", "back", "left", "right", "vertical", "level", "top", "bottom", "inside", "outside", "clockwise", "counterclockwise", etc. are based on the orientations or the positional relationships shown in the drawings, for the convenience of describing the present application and the simplifying the descriptions, instead of indicating or implying that the device or component referred to has a particular orientation in a particular configuration and orientation, cannot be construed as a limitation on the present application. In addition, the terms "first" and "second" are used for descriptive purposes only and are not to be construed as indicating or implying relative importance or implicit indication of the number of indicated technical features. Therefore, the number of "first", "second" features may be explicitly or implicitly included in one or more of the described features. In the description of the present application, the meaning of "a plurality of" is two or more than two, unless otherwise specifically defined.

In the description of the present application, it should be noted that the terms "installation", "interconnection", and "connection" should be understood broadly, unless otherwise clearly defined and limited. For example, it may be fixed connection or detachable connection, or integrated connection, it may be mechanical connection, electrical connection or intercommunication, it may be direct connection or indirect connection through an intermediate medium, or it may be internal communication of two components or mutual interaction of two components. For those with ordinary skill in the art, specific meanings of the above terms in the present application can be understood on a case-by-case basis.

In the present application, the expression of the first feature being "above" or "under" the second feature may include direct contact of the first and second features, and may also include indirect contact through other feature between the first and second features, unless otherwise specifically stated and defined. Moreover, the expression of the first feature being "on", "above", or "over" the second feature includes the first feature being right above or obliquely above the second feature or merely indicates that the level of the first feature is higher than that of the second feature. The expression of the first feature being "under", "beneath", or "below" the second feature may include the first feature being right below or obliquely under the second feature or merely indicates that the level of the first feature is lower than that of the second feature.

The following disclosure provides a number of different implementations or examples for implementing the different structures of the present application. To simplify the disclosure of the present application, the components and settings of the specific examples are described below. Certainly, they are merely examples, and are not intended to limit the present application. In addition, the present application may repeat reference numerals and/or reference letters in different examples. Such repetition is for the purpose of simplicity and clarity, and does not indicate the relationship between the various embodiments and/or the settings. In addition, the present application provides examples of various specific processes and materials, but those of ordinary skill in the art will be aware of the application of other processes and/or the use of other materials.

One embodiment of the present application provides a scan signal generation method applicable to a driver chip. It should be noted that the driver chip may be any one chip installed in the display panel. One embodiment of the present application is directed to integrating the scan signal generation method into the chip to implement corresponding functions. The driver chip is electrically connected to a plurality of scan lines. The scan signal generation method provided by one embodiment of the present application outputs the generated plurality of scan signals to a plurality of scan lines. In other words, the plurality of scan signals generated by the scan signal generation method according to one embodiment of the present application is in one-to-one correspondence with the plurality of scan lines.

Referring to FIG. 1, FIG. 1 is a schematic flowchart of a scan signal generation method according to one embodiment of the present application. As shown in FIG. 1, the scan signal generation method according to one embodiment of the present application includes the following steps:

In Step S101, an initial clock signal is acquired.

The initial clock signal is a signal with a certain frequency and an amplitude. In other words, the initial clock signal switches back and forth between a high level and a low level at a certain frequency. In addition, the frequency and the amplitude of the initial clock signal can set according to the needs of the user.

For example, when the driver chip is operating, the user can input a frequency value and an amplitude value according to specific needs, so that the driver chip can directly acquire an initial clock signal corresponding to the frequency and the amplitude.

In Step S102, the initial clock signal is processed to generate a plurality of target clock signals.

The target clock signal is a signal generated by the driver chip according to the acquired initial clock signal and having the same amplitude as the initial clock signal with a different frequency. In addition, the frequencies of different target clock signals are not equal.

Figure 2:
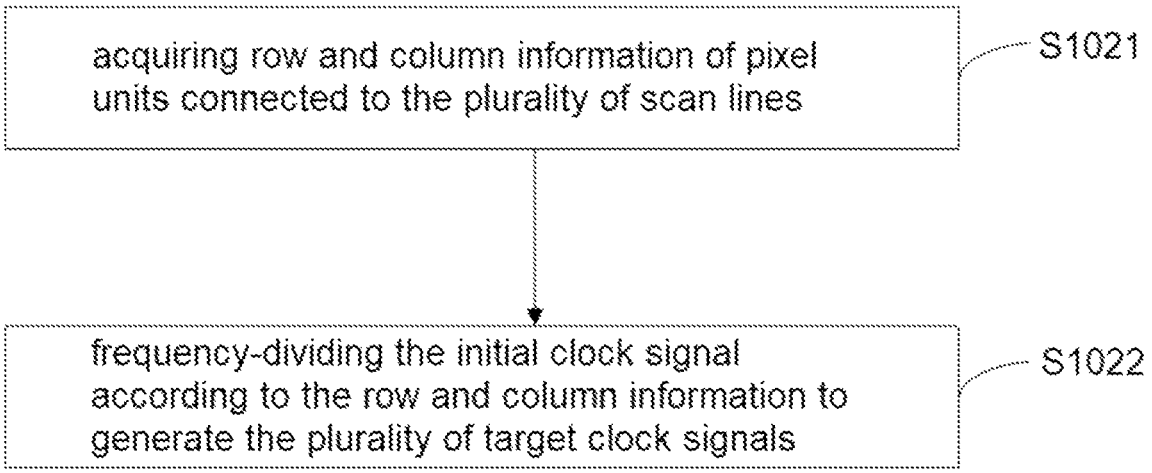
FIG. 2 is a schematic flowchart of a specific process of Step S102 in the scan signal generation method as shown in FIG. 1.

Referring to FIG. 2, FIG. 2 is a schematic flowchart of a specific process of Step S102 in the scan signal generation method as shown in FIG. 1. In some embodiments, as shown in FIG. 2, Step S102 includes the following steps:

In Step S1021, row and column information of pixel units connected to the plurality of scan lines is acquired.

The row and column information is the number of rows of pixel units of the display panel. For example, for a 1024-level display panel, 1024 scan signals are required. In other words, meanwhile, the number of rows of pixel units of the display panel is 1024.

In Step S1022, the initial clock signal is frequency-divided according to the row and column information to generate the plurality of target clock signals.

The number of generated target clock signals can be acquired according to the row and column information acquired in Step S1022. In other words, the number of generated target clock signals can be acquired according to the following relationship: $A=2^B$, where A is the number of rows of pixel units of the display panel, and B is the number of generated target clock signals.

For example, a 1024-level display panel is also taken as an example, which requires 1024 scan signals. Meanwhile, the number of rows of pixel units of the display panel is 1024. In other words, ten target clock signals need to be generated.

In addition, the frequency of the generated target clock signal is also related to the frequency of the initial clock signal, and can be acquired according to the following relationship: $C_i=D*1/2^i$, where C is the frequency of the $i^{th}$ target clock signal, and D is the frequency of the initial clock signal, and i is a positive integer larger than zero.

Furthermore, the initial clock signal may be frequency-divided by a frequency divider. For example, taking a 1024-level display panel as an example, the initial clock signal can be frequency-divided by a frequency divider to acquire a first target clock signal. Next, the first target clock signal is frequency-divided by two to acquire a second target clock signal. Then, the second target clock signal is frequency-divided by two to acquire a third target clock signal. Then, the third target clock signal is frequency-divided by two to acquire a fourth target clock signal. Then, the fourth target clock signal is frequency-divided by two to acquire a fifth target clock signal. Then, the fifth target clock signal is frequency-divided by two to acquire a sixth target clock signal. Then, the sixth target clock signal is frequency-divided by two to acquire a seventh target clock signal. Then, the seventh target clock signal is frequency-divided by two to acquire an eighth target clock signal. Then, the eighth target clock signal is frequency-divided by two to acquire a ninth target clock signal. Finally, the ninth target clock signal is frequency-divided by two to acquire a tenth target clock signal.

In Step S103, the plurality of target clock signals is encoded according to a predetermined logic relationship to generate a plurality of ordered logic signals.

The plurality of ordered logic signals is formed by combining a plurality of logic signals according to the predetermined logic relationship. It should be noted that the logic signal is a signal having two states. In other words, the value of a logic signal can be 0 or 1. In addition, in the target clock signals generated in Step S101, the target clock signal is at a high level with a corresponding logic signal being 1, or the target clock signal is at a low level with a corresponding logic signal being 0.

Furthermore, the number of logic signals in the plurality of ordered logic signals is consistent with the number of target clock signals. An ordered logic signal includes a logic signal corresponding to each target clock signal. For example, when three target clock signals are generated in Step S102, the ordered logic signals may be 000, 001, 010, 011, 100, 101, 110, 111.

Figure 3:
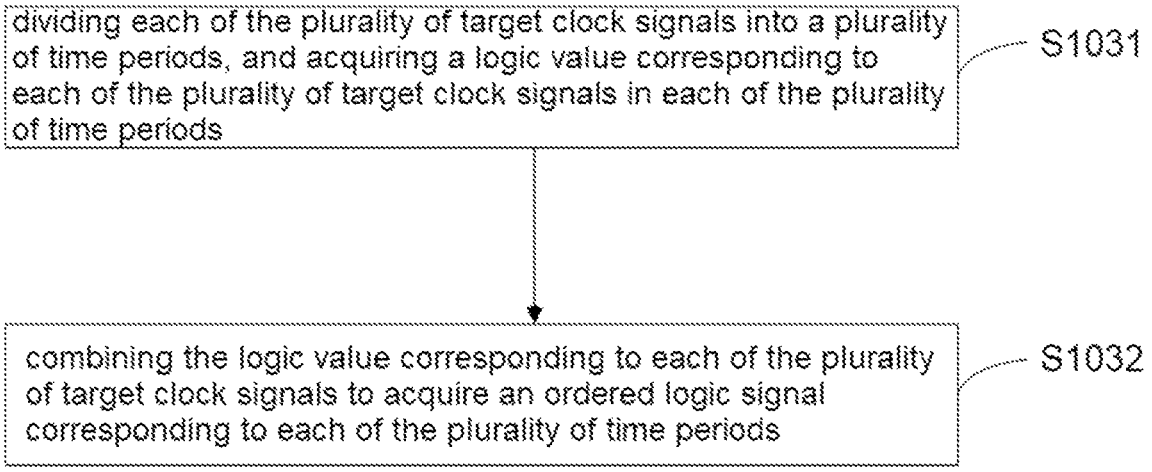
FIG. 3 is a schematic flowchart of a specific process of Step S103 in the scan signal generation method as shown in FIG. 1.

Referring to FIG. 3. FIG. 3 is a schematic flowchart of a specific process of Step S103 in the scan signal generation method as shown in FIG. 1. In some embodiments, as shown in FIG. 3, Step S103 includes the following steps:

In Step S1031, each of the plurality of target clock signals is divided into a plurality of time periods to acquire a logic value corresponding to each of the plurality of target clock signals in each of the plurality of time periods.

The interval of each time period is the same, and the interval of each time period is equal to the period of the initial clock signal. It should be noted that the level value of any target clock signal in any time period is a high level or a low level. In other words, any target clock signal corresponds to a logic value being 1 or 0 in any time period.

In Step S1032, the logic value corresponding to each of the plurality of target clock signals is combined to acquire an ordered logic signal corresponding to each of the plurality of time periods.

From right to left, the first bit of an ordered logic signal is the logic value of the first target clock signal in the corresponding time period, the second bit of an ordered logic signal is the logic value of the second target clock signal in the corresponding time period, and so on. The last bit of an ordered logic signal is the logic value of the last target clock signal in the corresponding time period.

For example, taking the generation of three target clock signals in Step S102 as an example, 001 indicates that the logic value of the first target clock signal in the corresponding time period is 1, the logic value of the second target clock signal in the corresponding time period is 0, and the logic value of the third target clock signal in the corresponding time period is 0.

In Step S104, the plurality of ordered logic signals is decoded to generate a plurality of scan signals according to a decoding result.

Figure 4:
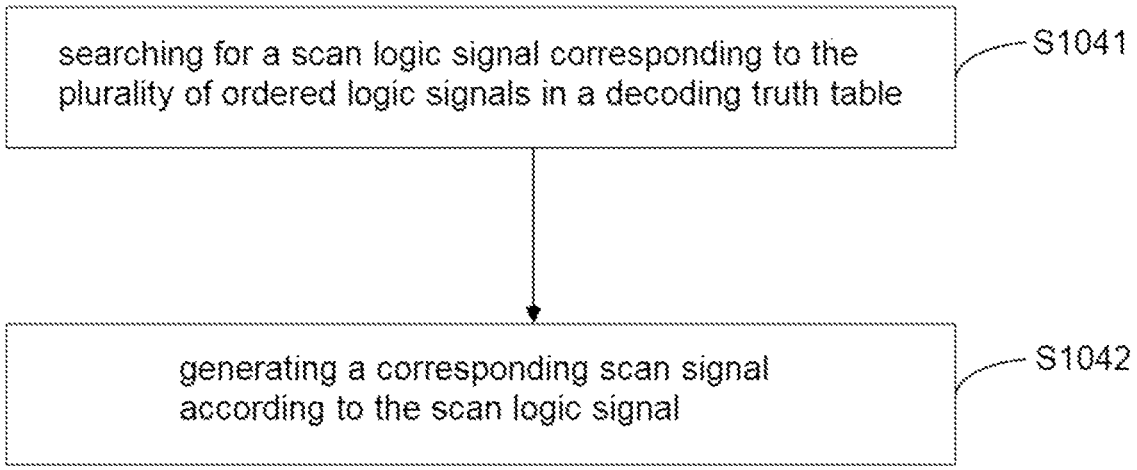
FIG. 4 is a schematic flowchart of a specific process of Step S104 in the scan signal generation method as shown in FIG. 1.

Referring to FIG. 4, FIG. 4 is a schematic flowchart of a specific process of Step S104 in the scan signal generation method as shown in FIG. 1. In some embodiments, as shown in FIG. 4, Step S104 includes the following steps:

In Step S1041, a scan logic signal corresponding to the plurality of ordered logic signals is searched for in a decoding truth table.

In Step S1042, a corresponding scan signal is generated according to the scan logic signal.

The scan signal generation method according to one embodiment of the present application uses an initial clock signal to generate a plurality of scan signals by acquiring the initial clock signal, processing the initial clock signal to generate a plurality of target clock signals, encoding the plurality of target clock signals according to a predetermined logic relationship to generate a plurality of ordered logic signals, decoding the plurality of ordered logic signals, and generating the plurality of scan signals according to a decoding result, to drive a display panel without using too many shift registers.

The scan signal generation method according to one embodiment of the present application will be specifically described below by taking the generation of eight scan signals as an example. A person skilled in the art can derive the applications with a plurality of scan signals without any effort from this example.

Figure 5:
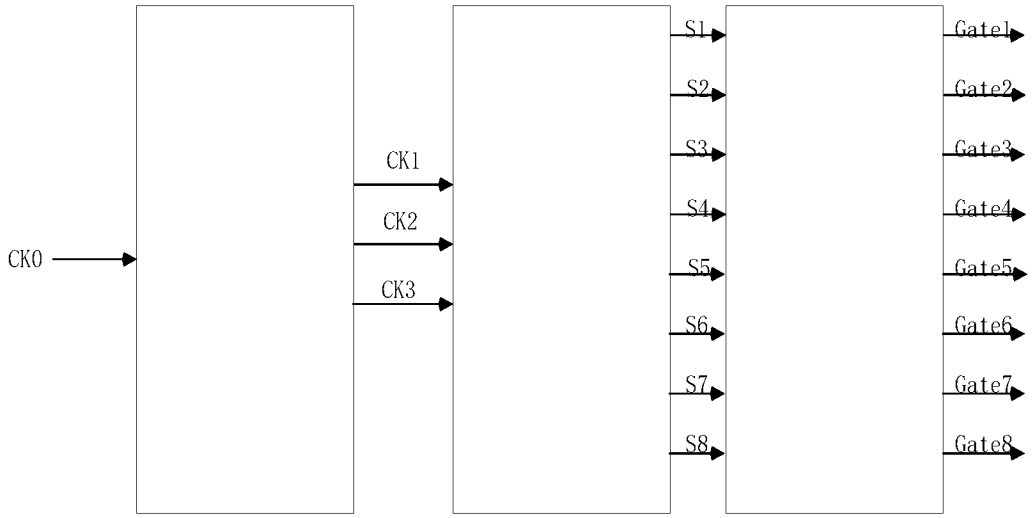
FIG. 5 is a schematic structural diagram for the generation of eight scan signals by using a scan line generation method according to one embodiment of the present application.

Referring to FIG. 5, FIG. 5 is a schematic structural diagram for the generation of eight scan signals by using a scan line generation method according to one embodiment of the present application. As shown in FIG. 5, the scan line generation method according to one embodiment of the present application first acquires an initial clock signal CK0; then processes the initial clock signal CK0 to generate a first target clock signal CK1, a second target clock signal CK2, and a third target clock signal CK3, next, encodes the first target clock signal CK1, the second target clock signal CK2, and the third target clock signal CK3 according to a predetermined logic relationship to generate a first ordered logic signal S1, a second ordered logic signal S2, a third ordered logic signal S3, a fourth ordered logic signal S4, a fifth ordered logic signal S5, a sixth ordered logic signal S6, a seventh ordered logic signals S7, and an eighth ordered logic signal S8; and finally, decodes the first ordered logic signal S1, the second ordered logic signal S2, the third ordered logic signal S3, the fourth ordered logic signal S4, the fifth ordered logic signal S5, the sixth ordered logic signal S6, the seventh ordered logic signal S7, and the eighth ordered logic signal S8 according to a decoding result to generate a first scan signal Gate1, a second scan signal Gate2, and a third scan signal Gate3, the fourth scan signal Gate4, a fifth scan signal Gate5, a sixth scan signal Gate6, a seventh scan signal Gate7, and an eighth scan signal Gate8.

Figure 6:
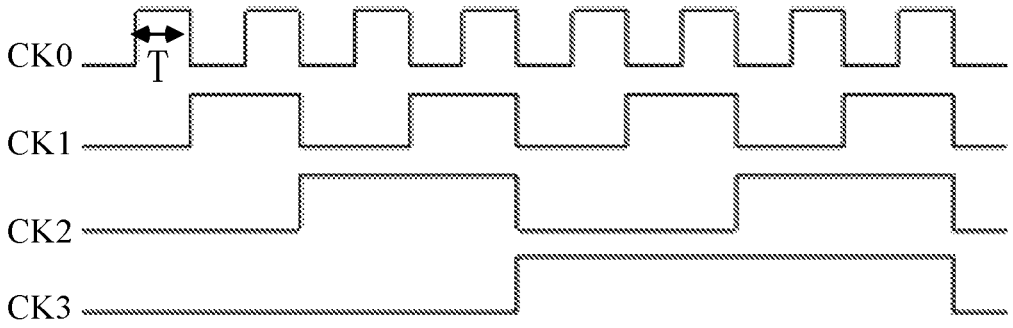
FIG. 6 is a first timing diagram corresponding to the generation of eight scan signals as shown in FIG. 5.

Referring to FIG. 5 and FIG. 6, FIG. 6 is a first timing diagram corresponding to the generation of eight scan signals as shown in FIG. 5. As shown in FIG. 5 and FIG. 6, the period of the initial clock signal CK0 is 2T. In other words, the frequency of the initial clock signal CK0 is ½T. The initial clock signal CK0 switches back and forth between a high level and a low level at a frequency of ½T. The first target clock signal CK1 switches back and forth between a high level and a low level at a frequency of ¼T. The second target clock signal CK2 switches back and forth between a high level and a low level at a frequency of ⅛T. The third target clock signal CK3 switches back and forth between a high level and a low level at a frequency of 1/16T.

Figure 7:
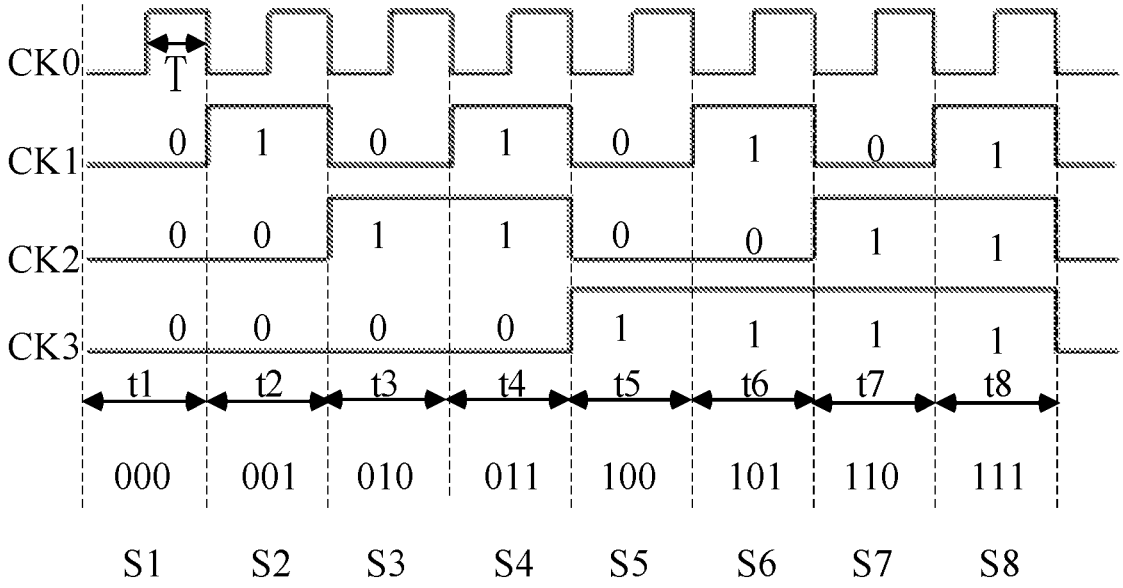
FIG. 7 is a schematic encoding diagram corresponding to the generation of eight scan signals as shown in FIG. 5.

Referring to FIG. 5, FIG. 6, and FIG. 7, FIG. 7 is a schematic encoding diagram corresponding to the generation of eight scan signals as shown in FIG. 5. As shown in FIG. 5, FIG. 6, and FIG. 7, the first target clock signal CK1 is frequency-divided into a plurality of time periods, the second target clock signal CK2 is frequency-divided into a plurality of time periods, and the third target clock signal CK3 is frequency-divided into a plurality of time periods. The interval of each time period is 2T, and each time period corresponds to a logic value.

The logic value of the first clock signal CK1 in the first time period t1 is 0, the logic value of the first clock signal CK1 in the second time period t2 is 1, the logic value of the first clock signal CK1 in the third time period t3 is 0, the logic value of the first clock signal CK1 in the fourth time period t4 is 1, the logic value of the first clock signal CK1 in the fifth time period t5 is 0, the logic value of the first clock signal CK1 in the sixth time period t6 is 1, the logic value of the first clock signal CK1 in the seventh time period t7 is 0, and the logic value of the first clock signal CK1 in the eighth time period t8 is 1.

The logic value of the second clock signal CK2 in the first time period t1 is 0, the logic value of the second clock signal CK2 in the second time period t2 is 0, the logic value of the second clock signal CK2 is in the third time period t3 is 1, the logic value of the second clock signal CK2 in the fourth time period t4 is 1, the logic value of the second clock signal CK2 in the fifth time period t5 is 0, the logic value of the second clock signal CK2 in the sixth time period t6 is 0, the logic value of the second clock signal CK2 in the seventh time period t7 is 1, and the logic value of the second clock signal CK2 in the eighth time period t8 is 1.

The logic value of the third clock signal CK3 in the first time period t1 is 0, the logic value of the third clock signal CK3 in the second time period t2 is 0, the logic value of the third clock signal CK3 in the third time period t3 is 0, the logic value of the third clock signal CK3 in the fourth time period t4 is 0, the logic value of the third clock signal CK3 in the fifth time period t5 is 1, the logic value of the third clock signal CK3 is in the sixth time period t6 is 1, the logic value of the third clock signal CK3 in the seventh time period t7 is 1, and the logic value of the third clock signal CK3 in the eighth time period t8 is 1.

Therefore, the ordered logic signal S1 in the first time period t1 is 000, the ordered logic signal S2 in the second time period t2 is 001, the ordered logic signal S3 in the third time period t3 is 010, the ordered logic signal S4 in the fourth time period t4 is 011, the ordered logic signal S5 in the fifth time period t5 is 100, the ordered logic signal S6 in the sixth time period t6 is 101, the ordered logic signal S7 in the seventh time period t7 is 110, and the ordered logic signal S8 in the eighth time period t8 is 111.

Figures 8, 9:
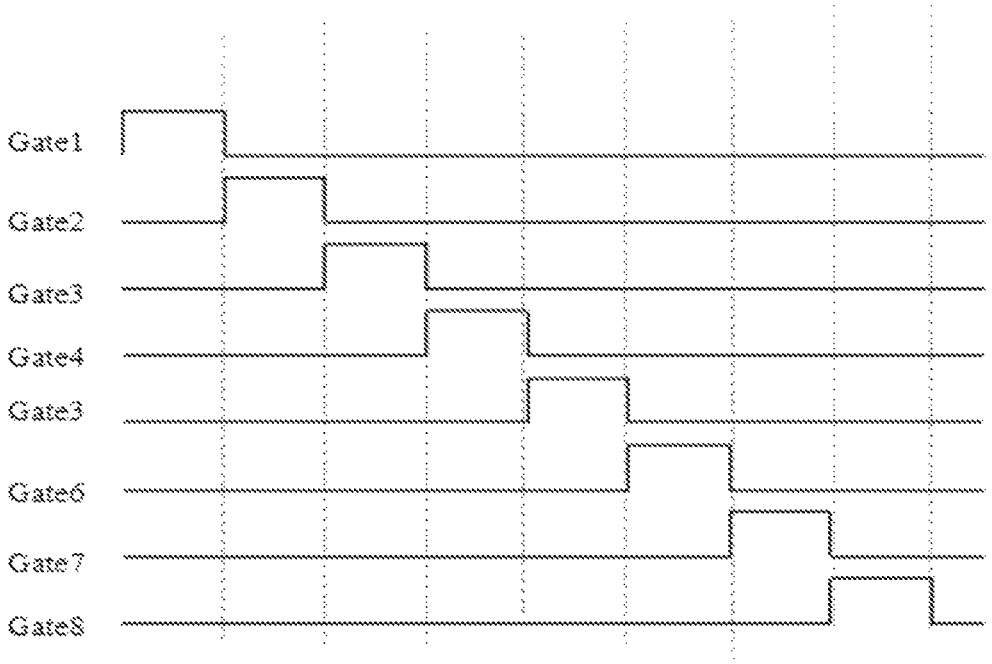
FIG. 8 is a decoding truth table corresponding to the generation of eight scan signals as shown in FIG. 5.
FIG. 9 is a second timing diagram corresponding to the generation of eight scan signals as shown in FIG. 5.

Referring to FIG. 5, FIG. 6, FIG. 7, FIG. 8, and FIG. 9, FIG. 8 is a decoding truth table corresponding to the generation of eight scan signals as shown in FIG. 5 and FIG. 9 is a second timing diagram corresponding to the generation of eight scan signals as shown in FIG. 5. As shown in FIG. 5, FIG. 6, FIG. 7, FIG. 8, and FIG. 9, the scan logic signal corresponding to the first ordered logic signal S1 is 10000000, the scan logic signal corresponding to the second ordered logic signal S2 is 01000000, the scan logic signal corresponding to the third ordered logic signal S3 is 00100000, the scan logic signal corresponding to the fourth ordered logic signal S4 is 00010000, the scan logic signal corresponding to the fifth ordered logic signal S5 is 00001000, the scan logic signal corresponding to the sixth ordered logic signal S6 is 00000100, the scan logic signal corresponding to the seventh ordered logic signal S7 is 00000010, and the scan logic signal corresponding to the eighth ordered logic signal S8 is 00000001. Therefore, the first scan signal Gate1, the second scan signal Gate2, the third scan signal Gate3, the fourth scan signal Gate4, the fifth scan signal Gate5, the sixth scan signal Gate6, the seventh scan signal Gate7, and the eighth scan signal Gate8 can be generated based on the decoded scan logic signals.

Figure 10:
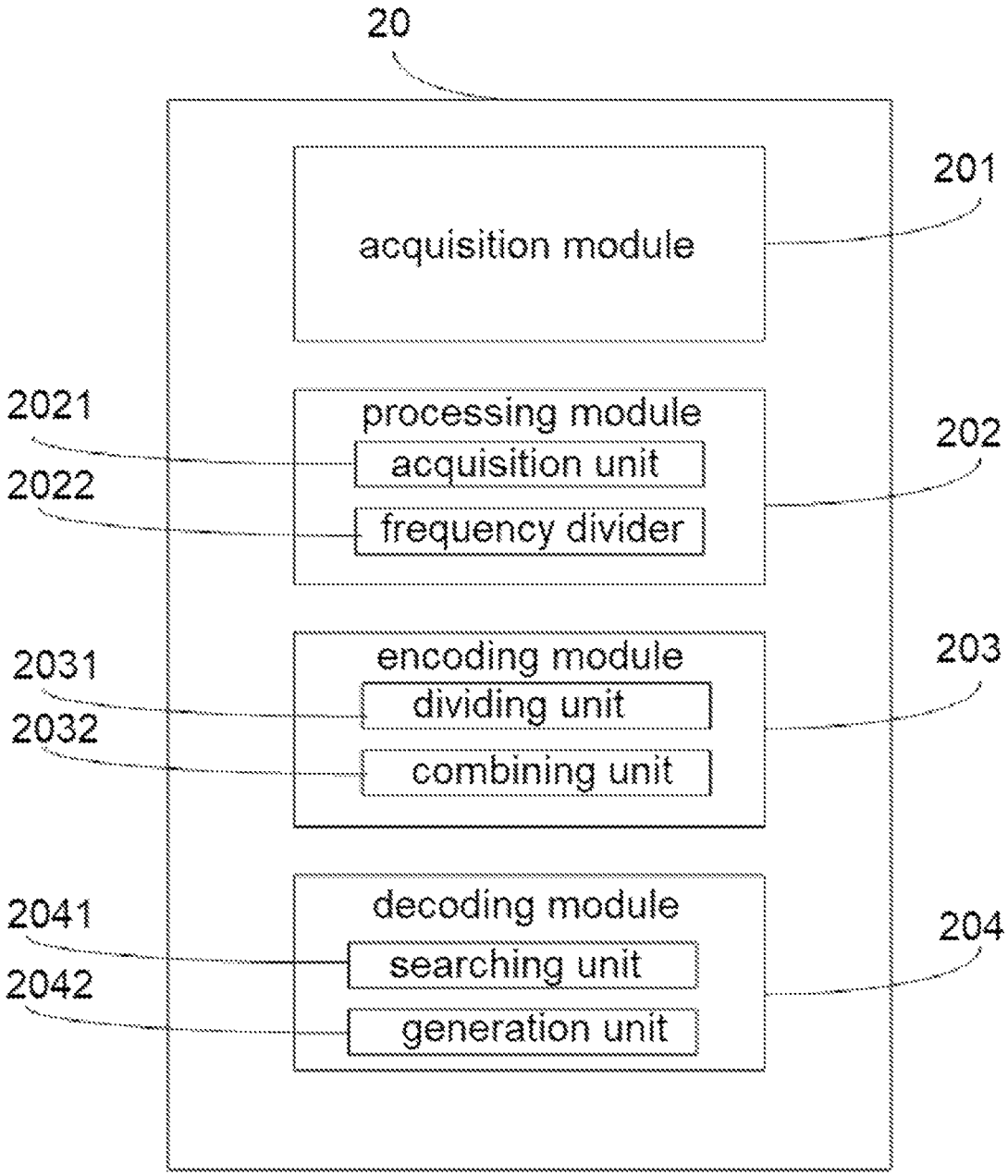
FIG. 10 is a schematic structural diagram of a scan signal generation device according to one embodiment of the present application.

One embodiment of the present application further provides a scan signal generation device. Referring to FIG. 10, FIG. 10 is a schematic structural diagram of a scan signal generation device according to one embodiment of the present application. As shown in FIG. 10, the scan signal generation device 20 includes an acquisition module 201, a processing module 202, an encoding module 203, and a decoding module 204.

Among them, the acquisition module 201 is configured to acquire an initial clock signal. The processing module 202 is configured to process the initial clock signal to generate a plurality of target clock signals. The encoding module 203 is configured to encode the plurality of target clock signals according to a predetermined logic relationship to generate a plurality of ordered logic signals. The decoding module 204 is configured to decode the plurality of ordered logic signals and generate a plurality of scan signals according to a decoding result. the acquisition module 201 is configured to acquire initial clock signal.

In some embodiments, the processing module 202 includes an acquisition unit 2021 and a frequency divider unit 2022. The acquisition unit 2021 is configured to acquire row and column information of pixel units connected to the plurality of scan lines. The frequency divider unit 2022 is configured to frequency-divide the initial clock signal according to the row and column information to generate the plurality of target clock signals.

In some embodiments, the encoding module 203 includes a dividing unit 2031 and a combining unit 2032. The dividing unit 2031 is configured to divide each of the plurality of target clock signals into a plurality of time periods and acquire a logic value corresponding to each of the plurality of target clock signals in each of the plurality of time periods. The combining unit 2032 is configured to combine the logic value corresponding to each of the plurality of target clock signals to acquire an ordered logic signal corresponding to each of the plurality of time periods.

In some embodiments, the decoding module 204 includes a searching unit 2041 and a generation unit 2042. The searching unit 2041 is configured to search for a scan logic signal corresponding to the plurality of ordered logic signals in a decoding truth table. The generating unit 2042 is configured to generate a corresponding scan signal according to the scan logic signal.

One embodiment of the present application further provides an electronic device including a processor and a memory. The memory is provided with computer programs stored therein, and the processor is configured to execute the scan signal generation method in the foregoing embodiment by allocating the computer programs stored in the memory to implement the following functions: acquiring an initial clock signal; processing the initial clock signal to generate a plurality of target clock signals; encoding the plurality of target clock signals according to a predetermined logic relationship to generate a plurality of ordered logic signals; and decoding the plurality of ordered logic signals, and generating a plurality of scan signals according to a decoding result, wherein the plurality of scan signals is in one-to-one correspondence with the plurality of scan lines.

It should be noted that those skilled in the art can understand that all or part of the steps in the foregoing embodiments can be completed by a program instructing related hardware, and the program can be stored in a computer readable storage medium. The storage medium may include, but is not limited to, a read-only memory (ROM), a random-access memory (RAM), a magnetic disk, and an optical disk.

The above-mentioned embodiments are merely illustrative of several embodiments of the present application, and the description thereof is more specific and detailed, but is not to be construed as a limitation to the scope of the present application. It should be noted that a number of variations and modifications may be made by those skilled in the art without departing from the spirit and scope of the present application. Therefore, the scope of the present application should be defined by the appended claims.

What is claimed is:

1. A scan signal generation method applicable to a driver chip electrically connected to a plurality of scan lines, wherein the scan signal generation method comprises:

acquiring an initial clock signal switching back and forth between a high level and a low level;

processing the initial clock signal to generate a plurality of target clock signals;

encoding the plurality of target clock signals according to a predetermined logic relationship to generate a plurality of ordered logic signals; and decoding the plurality of ordered logic signals, and generating a plurality of scan signals according to a decoding result, wherein the plurality of scan signals is in one-to-one correspondence with the plurality of scan lines;

wherein the step of encoding the plurality of target clock signals according to the predetermined logic relationship to generate the plurality of ordered logic signals comprises:

dividing each of the plurality of target clock signals into a plurality of time periods, and acquiring a logic value corresponding to each of the plurality of target clock signals in each of the plurality of time periods; and combining the logic value corresponding to each of the plurality of target clock signals to acquire an ordered logic signal corresponding to each of the plurality of time periods.

2. The scan signal generation method according to claim 1, wherein the step of processing the initial clock signal to generate the plurality of target clock signals comprises:

acquiring row and column information of pixel units connected to the plurality of scan lines; and frequency-dividing the initial clock signal according to the row and column information to generate the plurality of target clock signals, wherein the frequency of the $i^{th}$ target clock signal is $1/2^i$ of the frequency of the initial clock signal, i being a positive integer larger than zero.

3. The scan signal generation method according to claim 2, wherein the initial clock signal is frequency-divided by a frequency divider.

4. The scan signal generation method according to claim 1, wherein the step of decoding the plurality of ordered logic signals and generating the plurality of scan signals according to the decoding result comprises:

searching for a scan logic signal corresponding to the plurality of ordered logic signals in a decoding truth table; and generating a corresponding scan signal according to the scan logic signal.

5. A scan signal generation method applicable to a driver chip electrically connected to a plurality of scan lines, wherein the scan signal generation method comprises:

acquiring an initial clock signal;

processing the initial clock signal to generate a plurality of target clock signals;

encoding the plurality of target clock signals according to a predetermined logic relationship to generate a plurality of ordered logic signals; and decoding the plurality of ordered logic signals, and generating a plurality of scan signals according to a decoding result, wherein the plurality of scan signals is in one-to-one correspondence with the plurality of scan lines;

wherein the step of encoding the plurality of target clock signals according to the predetermined logic relationship to generate the plurality of ordered logic signals comprises:

dividing each of the plurality of target clock signals into a plurality of time periods, and acquiring a logic value corresponding to each of the plurality of target clock signals in each of the plurality of time periods; and combining the logic value corresponding to each of the plurality of target clock signals to acquire an ordered logic signal corresponding to each of the plurality of time periods.

6. The scan signal generation method according to claim 5, wherein the step of processing the initial clock signal to generate the plurality of target clock signals comprises:

acquiring row and column information of pixel units connected to the plurality of scan lines; and frequency-dividing the initial clock signal according to the row and column information to generate the plurality of target clock signals, wherein the frequency of the $i^{th}$ target clock signal is $1/2^i$ of the frequency of the initial clock signal, i being a positive integer larger than zero.

7. The scan signal generation method according to claim 6, wherein the initial clock signal is frequency-divided by a frequency divider.

8. The scan signal generation method according to claim 5, wherein the step of decoding the plurality of ordered logic signals and generating the plurality of scan signals according to the decoding result comprises:

searching for a scan logic signal corresponding to the plurality of ordered logic signals in a decoding truth table; and generating a corresponding scan signal according to the scan logic signal.

9. A scan signal generation device, comprising:

an acquisition module configured to acquire an initial clock signal;

a processing module configured to process the initial clock signal to generate a plurality of target clock signals;

an encoding module configured to encode the plurality of target clock signals according to a predetermined logic relationship to generate a plurality of ordered logic signals; and a decoding module configured to decode the plurality of ordered logic signals and generate a plurality of scan signals according to a decoding result, wherein the plurality of scan signals is in one-to-one correspondence with the plurality of scan lines;

wherein the encoding module comprises:

a dividing unit configured to divide each of the plurality of target clock signals into a plurality of time periods and acquire a logic value corresponding to each of the plurality of target clock signals in each of the plurality of time periods; and a combining unit configured to combine the logic value corresponding to each of the plurality of target clock signals to acquire an ordered logic signal corresponding to each of the plurality of time periods.

10. The scan signal generation device according to claim 9, wherein the processing module comprises:

an acquisition unit configured to acquire row and column information of pixel units connected to the plurality of scan lines; and a frequency divider unit configured to frequency-divide the initial clock signal according to the row and column information to generate the plurality of target clock signals, wherein the frequency of the $i^{th}$ target clock signal is $1/2^i$ of the frequency of the initial clock signal, i being a positive integer larger than zero.

11. The scan signal generation device according to claim 10, wherein the initial clock signal is frequency-divided by a frequency divider.

12. The scan signal generation device according to claim 9, wherein the decoding module comprises:

a searching unit configured to search for a scan logic signal corresponding to the plurality of ordered logic signals in a decoding truth table; and a generation unit configured to generate a corresponding scan signal according to the scan logic signal.

* * * * *